US008371362B2

(12) United States Patent
Pezzutti et al.

(10) Patent No.: US 8,371,362 B2
(45) Date of Patent: Feb. 12, 2013

(54) METHOD AND APPARATUS FOR THE PRODUCTION OF A CASTING

(75) Inventors: James Vernon Pezzutti, Gladesville (AU); Ewan O'Leary, Annandale (AU)

(73) Assignee: Weir Minerals Australia, Ltd. (AU)

( * ) Notice: Subject to any disclaimer, the term of this patent is extended or adjusted under 35 U.S.C. 154(b) by 226 days.

(21) Appl. No.: 12/452,340

(22) PCT Filed: Sep. 9, 2008

(86) PCT No.: PCT/AU2008/001335

§ 371 (c)(1),
(2), (4) Date: Dec. 21, 2009

(87) PCT Pub. No.: WO2009/033211

PCT Pub. Date: Mar. 19, 2009

(65) Prior Publication Data

US 2010/0135842 A1 Jun. 3, 2010

(30) Foreign Application Priority Data

Sep. 10, 2007 (AU) ..... 2007904899

(51) Int. Cl.
*B22D 30/00* (2006.01)
*C21D 1/84* (2006.01)

(52) U.S. Cl. ..... 164/122; 148/540; 266/259

(58) Field of Classification Search ..... 164/122, 164/123, 125, 348; 148/538, 540; 266/259
See application file for complete search history.

(56) References Cited

U.S. PATENT DOCUMENTS

| | | | | |
|---|---|---|---|---|
| 5,183,518 | A | 2/1993 | Radon | |
| 5,505,247 | A * | 4/1996 | Musschoot | 164/76.1 |
| 6,199,618 | B1 | 3/2001 | Fenne et al. | |

FOREIGN PATENT DOCUMENTS

| | | | | |
|---|---|---|---|---|
| CN | 2043899 | U | | 9/1989 |
| CN | 2522197 | Y | | 11/2002 |
| EP | 0625390 | B1 | | 11/1994 |
| GB | 1600405 | A | | 10/1981 |
| JP | 62-243717 | A | * | 10/1987 |
| JP | 04-344859 | A | | 12/1992 |
| JP | 07-195163 | A | | 8/1995 |
| JP | 2006258384 | A | | 9/2006 |
| WO | 2004/104253 | A1 | | 12/2004 |

* cited by examiner

*Primary Examiner* — Kevin P Kerns
(74) *Attorney, Agent, or Firm* — Morriss O'Bryant Compagni

(57) ABSTRACT

A method and apparatus for the production of a casting that includes pouring molten material into a mold for forming the casting, allowing the molten material to solidify, removing the mold at least in part from the resulting solidified casting, and locating the solidified casting in a chamber that completely surrounds and facilitates a controlled rate of cooling of the casting.

19 Claims, 6 Drawing Sheets

METHOD AND APPARATUS FOR THE PRODUCTION OF A CASTING

CROSS REFERENCE TO RELATED APPLICATIONS

This application is a national phase application based on International Application number PCT/AU/2008/001335, filed Sep. 9, 2008, and claims priority of Australian Patent Application number 2007904899, filed Sep. 10, 2007.

TECHNICAL FIELD

A method and apparatus are disclosed for the production of a casting. The method and apparatus find particular application to the casting of metals such as white cast irons as defined in Australian Standard AS2027-2007 (equivalent to International Standard ISO21988:2006). However, it should be appreciated that the method and apparatus can be applied to the casting of certain other ferrous metals including steel.

BACKGROUND ART

Certain materials (such as brittle materials, for example white cast iron) are cast in a mould and then allowed to solidify and cool in the mould over a number of days/weeks. For example, when a thick section (say, >150 mm) white cast iron component is cast from molten metal and placed in a sand mould, to avoid cracking it may be allowed to solidify and cool in the mould over a long period (in extreme cases up to around fourteen days). Slow cooling is employed to prevent cracking of the resulting component which can occur if the component is removed from the mould too early and exposed to the atmosphere for a time. However, a long cooling time results in significant delays in the production process, as well as occupying capital equipment and space.

U.S. Pat. No. 6,199,618, EP 625390, GB1600405 and JP 04-344859 each disclose controlled cooling processes and apparatus for castings. In each case the casting is conveyed through successively cooled stages of oven-like apparatus.

A reference herein to the prior art is not an admission that the prior art forms part of the common general knowledge of a person of ordinary skill in the art in Australia or elsewhere.

SUMMARY OF THE DISCLOSURE

In a first aspect there is disclosed a method for the production of a casting, the method comprising the steps of:

- pouring molten material into a mould for forming the casting;
- allowing the molten material to solidify;
- removing the mould at least in part from around the resulting solidified casting; and
- locating the solidified casting in a chamber that completely surrounds and facilitates a controlled rate of cooling of the casting.

By locating the solidified casting in a chamber that completely surrounds the casting, the method can allow the casting to be removed from a mould much earlier than is usually the case, and then the cooling of the casting can be controlled over a much shorter time period. For example, for certain thick section white cast iron components cast in a sand mould, the cast can be removed from the mould when it solidifies and then cooled in the chamber over a few days (rather than over as much as fourteen days in the mould, for example). Such removal from the mould is known variously in the art as "knock-out", "shake-out" or "break-out", whereby the method can provide for early "knock-out", "shake-out" or "break-out", and can also provide the cooled casting sooner to subsequent finishing procedures.

Thus, the method can reduce delays in the casting process, and consequently reduce delays in the overall production process. Furthermore, the method can make capital equipment and space available again more quickly for production of the next casting.

It should be understood that the terminology "completely surrounds the casting" as employed herein, does not exclude the chamber having gas ventilation passages and the like in wall(s) or a base thereof.

The method is typically though not exclusively used for the casting of brittle materials. Such materials are most susceptible to cracking as a result of thermal shock and so, prior to the present method, casting of these materials has required lengthy mould residence times to permit gradual cooling to occur. Such materials can include certain ferrous alloys such as white cast irons and steel. The method can thus find use in the reduction of the cooling time of a wide range of brittle cast materials and/or materials susceptible to thermal shock.

By completely surrounding the casting, the chamber can reduce any effect on the casting caused by air movement and flow immediately outside of the chamber. Advantageously, this can mitigate against thermal shock, which can otherwise lead to cracking of the casting during the cooling process.

In one form the chamber can be insulated to facilitate the controlled rate of cooling of the casting. Parameters such as the materials of construction of the chamber itself, the type of insulation material selected, and the thickness and/or heat transfer coefficient of that insulation material, can be selected to control the rate of cooling of the casting. For example, for a white cast iron casting, the rate of cooling can be controlled by the appropriate selection of such parameters so as not to exceed about 40° C./hour.

In addition, the chamber can be insulated so as to maintain a pre-selected temperature differential between a hottest portion and a coolest portion of the solidified casting, for example across the thickness of the casting. Maintaining this temperature differential can prevent weakening, cracking or breakage of the casting. In at least some casting embodiments the hottest portion can be located within the solidified casting and the coolest portion can be located at an external surface of the solidified casting. However, these locations can vary depending on the specific casting geometry.

In one particular example, when the casting comprises a body with a hollow interior in which some moulding material (such as moulding sand) has been retained, the chamber can be insulated so as to maintain a pre-selected temperature differential between:

(a) that part of the solidified casting hollow interior that is in contact with that moulding material; and (b) an external surface of the solidified casting from which moulding material has been removed or mostly removed.

For example, an impeller used in a centrifugal pump can generally be annular in shape and some of the moulding material may be retained in the central hollow region. In this regard, the temperature of the casting external surface can be determined from the chamber atmospheric temperature surrounding the casting.

In one example, when the material being cast is white cast iron, the pre-selected temperature differential that is maintained across the thickness of the solidified casting may be less than approximately 100° C.

Again, whilst such a temperature differential can vary for different materials, the differential is pre-selected to accommodate for a difference in material cooling rates (and thus a difference in contraction between, for instance, a casting interior and exterior), thereby tending to prevent or avoid material cracking or breaking.

In one form, prior to locating the solidified casting in the chamber, the mould can be fully removed from an exterior of the casting. For example, when the moulding material comprises sand, the moulding sand can be removed from the casting exterior by scraping or otherwise dislodging the sand particles before the casting is located in the chamber. However, as mentioned above, when the casting comprises a hollow interior, at least some if not all of the moulding material may be retained therein when the solidified casting is located in the chamber.

In addition, during removal of the mould from the casting exterior, gases emitted from the casting as it cools may be ventilated, for example by being drawn or moved away from the casting and the mould by a fan and directed towards a ventilation installation. Thus operator(s) can be protected from exposure to noxious gases (such as carbon monoxide and sulfur dioxide) that are emitted from the casting.

In the method of the first aspect, after removing the mould at least in part from the solidified casting, the casting can be lifted and deposited onto a base for the chamber. After that, a housing which forms the remainder the chamber can be located on the base to enclose the casting. This procedure can be simply configured and thus quickly enacted to thereby reduce the exposure time of the casting to the surrounding atmosphere before it is enclosed within the chamber. During this procedure, ventilation can be employed to dissipate/capture noxious mould off-gases such as carbon monoxide and sulfur dioxide.

The method of the first aspect can be used in conjunction with both sand casting and the so-called Replicast® moulding and casting technique (developed by Castings Technology International).

The inventors surmise that the method works because the apparatus simulates the thermal insulation properties of the sand mould, but replaces that mould with a relatively large air barrier, which is of lower thermal capacity and permits more rapid cooling.

The inventors further surmise that when a white cast iron material is cooling, over time there is a transformation of the metallurgy to form martensite, which has excellent hardness properties and is desirable in the final product. However, when martensite is formed it also results in a small expansion in size of the metal that has undergone sufficient cooling. If the temperature differential between a hottest portion and a coolest portion of a solidified casting is too great, then during cooling a 'skin' or outer layer of hard martensite can form on the outside of the casting well before such metallurgy is formed within the centre of a section of the casting. When the central core of the casting eventually does cool sufficiently to form martensite, the resulting small amount of expansion which then occurs in the metal can lead to cracking of the already hardened outermost 'skin' of the casting. This can cause a catastrophic failure of the casting and total wastage. The present inventive method and apparatus can address this by suitable, controlled cooling across casting sections.

In the method of the first aspect, and subsequent to the cooling process, there can also be a step of heating the chamber and the casting therein for a pre-determined interval. This heating step can be done to effect a heat treatment process on the casting which is enclosed in the chamber. Rather than removing the casting from the chamber after the interval in which a controlled rate of cooling occurs, the chamber can be operatively connected to an external heating source to enable it to be heated. The heating of the chamber subsequent to the controlled cooling of the casting can achieve an in-situ tempering of the casting. In one example, for a white cast iron product the chamber can be heated to around 1000° C. for a pre-determined interval of around 4 hours to effect the heat treatment process.

The method of the first aspect can comprise a further step of removing the casting from the chamber once it has cooled to a predetermined temperature. Such a temperature may be well above room temperature but not so high that when the casting is removed from the chamber it then cracks or breaks. For example, when the material being cast is a white cast iron, the predetermined temperature at which the casting is removed from the chamber can be approximately 150° C.

In a second aspect there is disclosed a method for cooling a newly solidified casting comprising the step of locating the casting in a chamber that completely surrounds and facilitates a controlled rate of cooling of the casting.

As with the first aspect, the method of the second aspect can reduce delays in the casting production process, as well as more quickly making capital equipment and space available again.

The terminology "newly solidified" is to be understood to refer to a casting that has solidified in a mould sufficiently such that it can be transferred to the chamber.

In other respects the method of the second aspect can form part of and be implemented as per the method of the first aspect.

Furthermore, in the method of the first and second aspects, the step of locating the casting in a chamber is to be understood to include the in-situ locating of a chamber around the newly solidified casting by formation of the chamber, or the positioning of a pre-made chamber, in position. For example, removal of just a cope of a moulding box may expose a sufficient amount of the casting to then enable the controlled rate of casting cooling to take place within the chamber.

In a third aspect there is disclosed apparatus for cooling of a casting, the apparatus comprising a chamber which is adapted to completely surround and facilitate a controlled rate of cooling of the casting.

Again, as with the first aspect, the apparatus of the third aspect can speed up the casting production process, whereby the apparatus can be more quickly re-used in the production procedure. The use of a surrounding chamber is also simple, cost-effective and space-effective, as compared to conveyor-type apparatus. Such apparatus can be easily moved by one operator using a forklift truck, stored and even stacked during cooling, in situations where there is limited working space. Such apparatus is well suited to a batch-type casting production process, as described herein.

In one form of the apparatus the chamber is insulated. For example, the chamber can be insulated with an insulation material having a pre-selected thickness and/or a pre-selected heat transfer coefficient, each of which may be selected so as to facilitate the controlled rate of cooling of the casting.

In one embodiment, the insulation material can be a refractory blanket that lines an interior surface of the chamber. The refractory blanket can be formed from a magnesium-calcium-silicate blanket material (such as is marketed under the trade mark Kaowool®, owned by Thermal Ceramics, Inc). However, the particular insulation material employed, its thickness and its heat transfer coefficient can be selected from many alternative materials so as to best control and optimise the rate of cooling of the casting.

In one form of the apparatus, the chamber comprises a base and a housing that is locatable on the base to close the chamber. For example, when the base and housing are combined they can be shaped and configured to define a square or rectangular enclosed box. However, the shape and configuration of the base and the housing may be optimised or approximated to the particular casting, depending on the circumstances.

Further, the chamber is typically formed of a material that can withstand the temperature of a newly solidified casting. For example, for a white cast iron casting, the chamber can be fabricated from steel (such as mild steel).

For certain cast materials where a faster rate of cooling can be tolerated (eg. faster than 40° C./hour) the insulation can be pared back and optionally vents and/or extractor fans may be incorporated into the housing. Alternatively, to retard cooling rate, gases having an insulating/blanketing or even a heating effect may be initially introduced into and then optionally enclosed within the chamber during cooling.

In a fourth aspect there is disclosed a casting that is produced by the method of the first and second aspects, or that is produced in the apparatus of the third aspect.

The casting of the fourth aspect is typically though not exclusively a brittle material and/or a material that is susceptible to thermal shock. In one form the casting is of white cast iron. Further, the white cast iron may have a chromium content ranging from 1.5 to 40 wt % and a carbon content varying from 0.5 to 5.5 wt %. In further embodiments, the white cast iron may have a chromium content of 25 to 35 wt %.

The casting can form any component of a pump, such as an impeller, a volute (shell/casing/housing), a pump lining, a throat bush, and so on. However, a vast array of components and shapes can be produced in accordance with the method and apparatus of the first to third aspects, not at all limited to pump components.

BRIEF DESCRIPTION OF THE DRAWINGS

Notwithstanding any other forms which may fall within the scope of the method and apparatus as set forth in the Summary, specific embodiments of the method and apparatus will now be described, by way of example, and with reference to the accompanying drawings in which.

DETAILED DESCRIPTION OF SPECIFIC EMBODIMENTS

Before describing a methodology for cooling of a casting, reference will first be made to FIG. 1 which shows a perspective view of an embodiment of a chamber suitable for facilitating controlled cooling.

Figure 1:
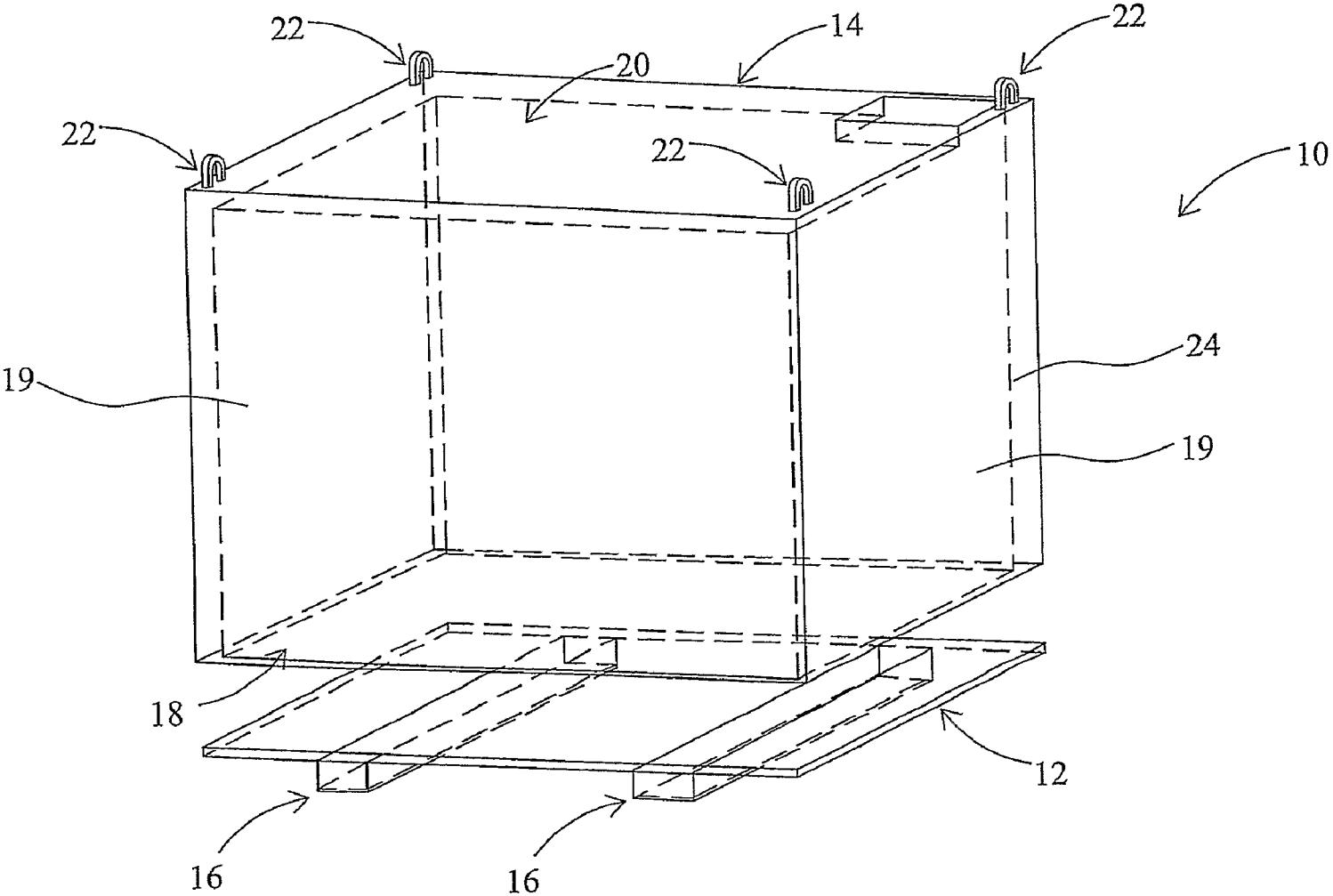
FIG. 1 shows a perspective view of a cooling chamber embodiment.

In FIG. 1, a chamber for facilitating a controlled rate of cooling is shown in the form of a cooling box 10. The box 10 comprises a generally rectangular base panel 12 and a housing in the form of a cover 14 which is arranged with four rectangular side panels 19 that are joined orthogonally to one another, and each of which depending from a top plate 20. The base panel 12 is spaced from the ground by hollow beams 16, which are also shaped and located to receive the tines of a forklift therein for lifting of the base panel 12 and for lifting an assembled/laden cooling box 10.

Figure 5:
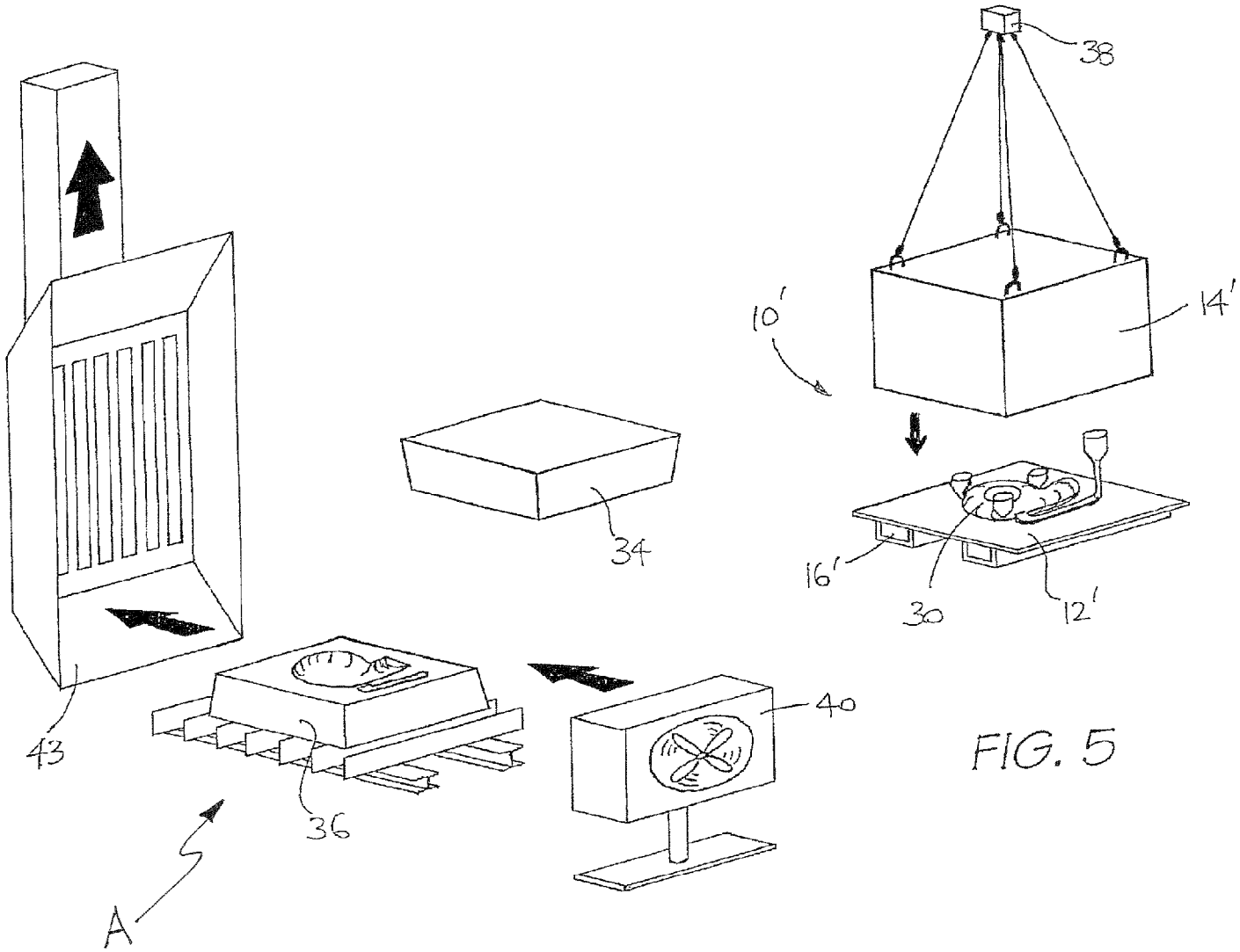

The cover 14 comprises a lower opening 18 which is mountable snugly at the base panel 12 and through which a casting which is located on the base 12 is received in use into the interior of the cover 14. The cover 14 has a top plate 20 that closes its uppermost end in use and which is arranged opposite to the opening 18. Four hook loops 22 are fastened to the outermost, upper surface of the top plate 20, to which the grappling hooks of an overhead crane can be attached (as shown in FIG. 5). This enables raising, lowering and movement of the cover 14 with respect to the base 12.

The base panel 12 and the cover 14 are fabricated from mild steel panels which have been welded together. The entire interior surfaces of the base panel 12 and cover 14 are lined with a refractory blanket 24 formed from a magnesium-calcium-silicate ($MgCaSiO_2$) blanket material (such as Kaowool® owned by Thermal Ceramics, Inc). The thickness and heat transfer coefficient of the blanket material is selected to best control and optimise the rate of cooling of the casting.

In use, the cooling box 10 completely surrounds a casting to enable it to cool at a controlled rate. The use of a box, as opposed to a more complex cooling oven with a conveyor arrangement, is simple as well as being cost effective and space efficient.

Some non-limiting Examples of a methodology for cooling of a casting will now be provided and which make use of the apparatus shown in FIG. 1. Reference will also be made to the schematic method sequence depicted in FIGS. 2 to 6.

Example 1

An investigation was made to develop a casting process that incorporated an early "knock-out" (removal) of a cast component from a sand mould. It was noted that many such components would normally be allowed to solidify and slowly cool in the mould over a period of several (3-6) days to prevent component cracking and breaking.

A white cast iron component 30 for a centrifugal pump was cast from molten metal in a sand-containing moulding box 32 having a cope (top half) 34 and drag (bottom half) 36. The component 30 was allowed to solidify and cool in the mould over a period of about 3 hours (a time determined by the modulus of the casting or the ratio of the total volume divided by surface area). For white cast iron pump components it was observed that the component temperature dropped from around 1390° C. to about 990-1000° C. over this period.

Once the component 30 had solidified (but was still red hot) the cope 34 of the moulding box 32 was removed by being lifted by a crane 38 and moved away from the drag 36. The moulding itself, being formed from a set sand material, was then generally broken away from the exterior of the component (for example, by being manually broken apart or by use of a remotely operated machine). Depending on the shape of the component, some sand was retained within its core (eg. a pump impeller had an internal cavity that was observed to remain partially sand-filled).

During removal of the cope 34 and removal of the sand from the exterior of the component 30 and up until enclosure of the component 30 within the cooling box 10', a fan 40 was positioned behind the operator 42 to generate a flow of air to move noxious gases released from the casting 30 and the mould to be moved towards and into a fume extraction system 43. This mitigated exposure of any operators 42 to such gases.

The component 30 was then engaged and lifted by grappling hooks to move it out of the drag 36, and to place it onto the base panel 12' of the cooling box 10'. The cover 14' was then moved into position by an overhead crane 38 so as to be seated on the base panel 12'. Thermocouples were positioned on, and inside of, the component 30, and within the cooling box 10' in a location that is spaced away from the component 30. Over time, recordings from these thermocouples have enabled the type of insulation material to be optimised. In one example, this was achieved by selecting a heat transfer coefficient and material thickness so that the rate of cooling of the casting 30 was able to be controlled to not exceed around 40° C./hour.

The component 30 was enclosed in the insulated, air-filled cooling box 10 and allowed to cool in a controlled manner over a period of around 2-5 days. Temperature recordings taken using the thermocouples ensured that the temperature differential between the interior and exterior of the component was maintained at less than approximately 100° C. to prevent the casting material from cracking over the cooling period. Any required adjustments in insulation material to maintain this differential were noted and made.

The end of the cooling period was denominated by a component temperature at which the component 30 could be removed from the cooling box 10' and into the surrounding atmosphere without cracking due to thermal shock. This varied according to component shape, size and material, but for white cast iron components was generally around 150° C.

Figure 2:
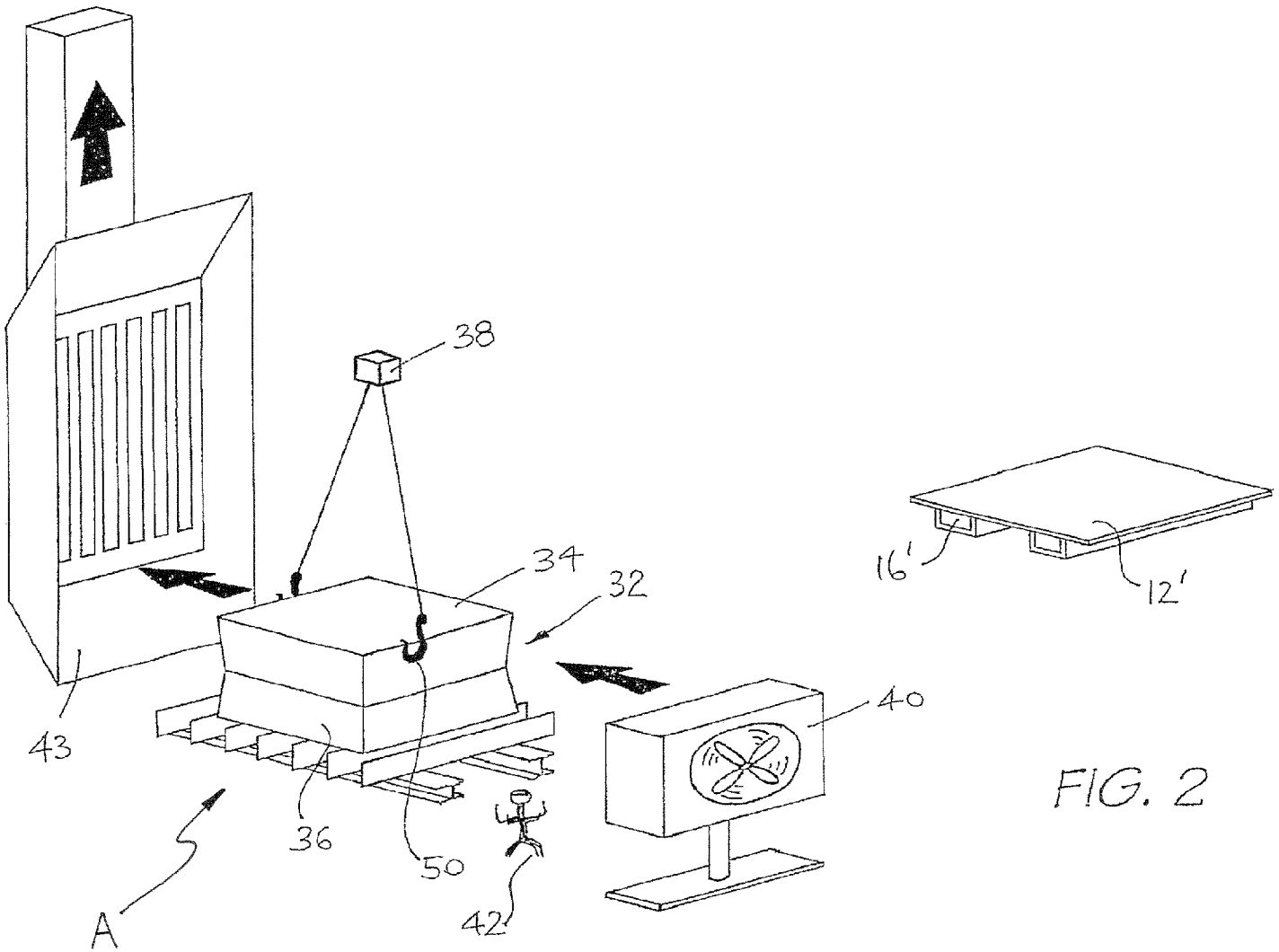
FIGS. 2 to 6 schematically depict the sequence of steps that is followed in a method for the production of a casting.

A schematic cooling methodology sequence is depicted in FIGS. 2 to 6 and will now be described as follows:

FIG. 2 shows a moulding box 32 being positioned by a crane at a work area A. In the work area, the base 12' of a cooling box 10' is positioned adjacent to the work area A. Also located adjacent to the work area is an extraction unit 43 to extract $SO_2$ and CO emissions (eg. which are emitted when the moulding box is opened).

FIG. 2 also shows that an operator 42 has positioned a fan unit 40 so as to draw or move atmospheric air across the moulding box 32 and towards the extraction unit 43, to prevent the noxious gases from reaching the operator 42. This movement of atmospheric air was maintained throughout the knock-out procedure.

Figure 3:
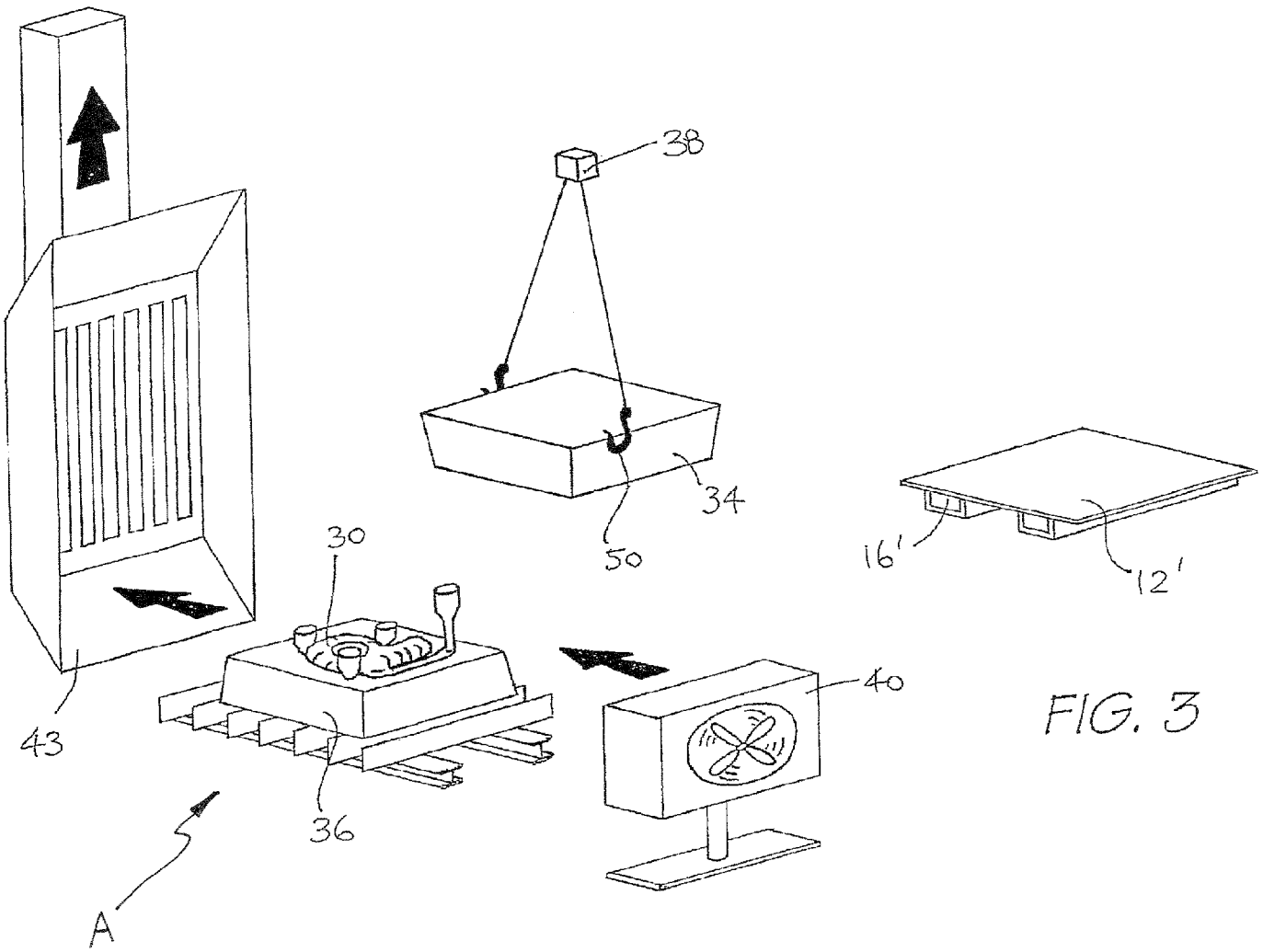

FIG. 3 illustrates the removal of the cope 34 of the moulding box 32 which was then placed on the floor of the work area A adjacent to the moulding box 30. The removal of the cope 34 exposes a moulded pump component 30 seated in the drag 36 of the moulding box 32. The operator 42 then proceeded to break away the sand moulding from the exterior of the component 30, for example by manually breaking the set sand apart or by use of some type of drilling machine.

Figure 4:
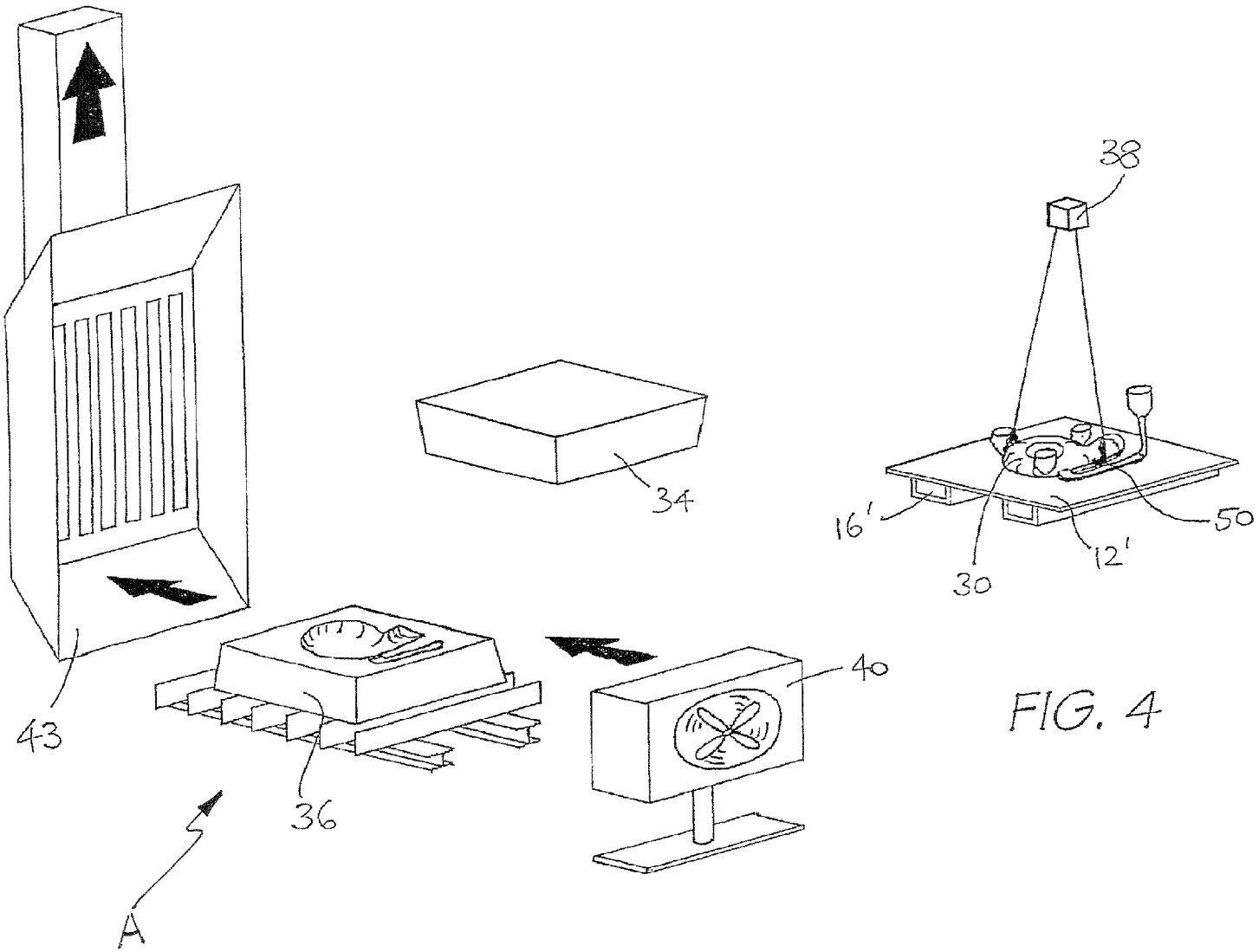

FIG. 4 illustrates the component 30 being lifted out of the drag 36 by using grappling hooks 50 connected to an overhead crane 38 to lift and to then lower the component 30 onto the base panel 12' of the cooling box 10'. During this time it will be seen that ventilation from the fan 40 and extraction of gases via the extraction unit 43 are maintained.

FIG. 5 illustrates the cooling box cover 14' being lifted and lowered onto the base panel 12' to thus enclose the component 30 within the box 10'.

Figure 6:
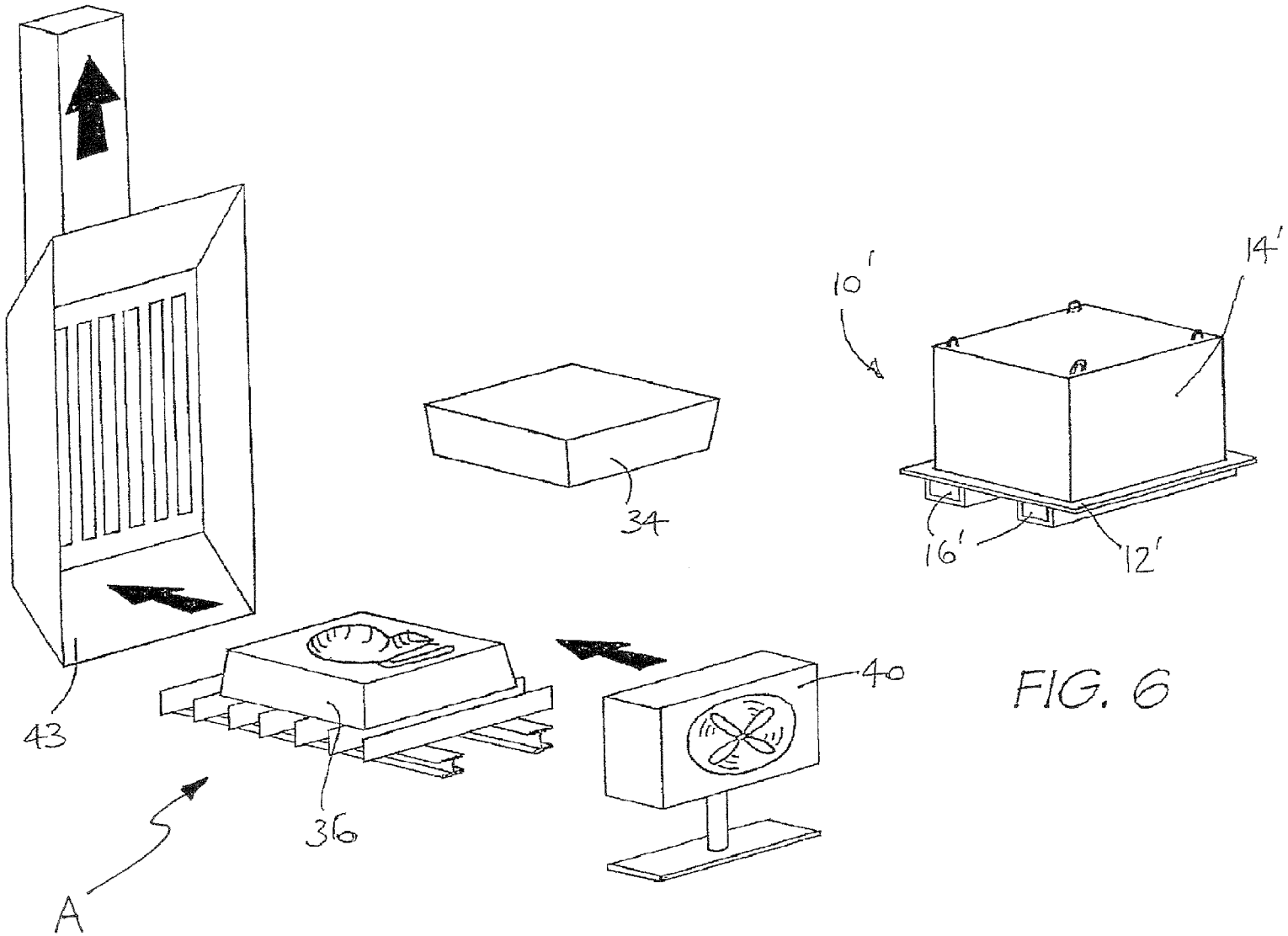

Finally, FIG. 6 indicates that the cooling box 10' can then be removed from the work area A (for example by means of a forklift which inserts its tines into the hollow beams 16'). The cooling box 10' housing the component 30 is taken to another location where controlled cooling of the component can take place, thus freeing up the work area A for more of the activities shown in FIGS. 2 to 5. In this regard, to minimise the amount of space occupied by such cooling boxes 10', the boxes 10' can be engineered so that they can be stacked one upon another (for instance, up to three boxes high).

During the whole operation, the operator 42 is generally isolated from the casting 30 as much as possible, through the careful use and placement of ventilation and of the overhead crane and grappling hooks.

Example 2

Applying the methodology of Example 1 the following results for different pump components were observed:

(a) A 900 kg centrifugal pump impeller was knocked out of the sand mould 93 minutes after pouring, and placed into the cooling box. The impeller was then able to be removed from the cooling box after 42 hrs. This compared favorably with a normal mould residence time for cooling of 72 hrs before knock-out.

(b) A 2190 kg centrifugal pump impeller was knocked out of the sand mould 180 minutes after pouring, and placed into the cooling box. The impeller was then able to be removed from the cooling box after 50 hrs. This compared favorably with a normal mould residence time for cooling of 120 hrs before knock-out.

(c) A 1200 kg centrifugal pump impeller was knocked out of the sand mould 95 minutes after pouring, and placed into the cooling box. The impeller was then able to be removed from the cooling box after 44 hrs. This compared favorably with a normal mould residence time for cooling of 144 hrs before knock-out.

In general, the results can be summarised in the following table:

| Component | Knock-out after: | Removed from cooling box after: | Percentage Lead time improvement | Max. cooling box removal temp. |
|---|---|---|---|---|
| (a) | 93 min. | 42 hours | 42% | 219° C. |
| (b) | 3 hours | 50 hours | 58% | 200° C. |
| (c) | 95 min. | 44 hours | 69% | 220° C. |

In the table the following terminology applies:

"Percentage Lead time improvement"—refers to the improvement in white cast iron casting cooling time calculated, for example (a), by the difference between 72 hours (normal mould cooling time) and 42 hours (time in the cooling box) divided by 72 hours—this results in 42%.

"Max. cooling box removal temp."—refers to the maximum temperature at which the casting can be removed from the cooling box without risk of cracking (below the temperature when expansion resulting from the formation of martensite occurs)

Observations

Although castings of white cast iron are very susceptible to cracking from thermal stress caused by premature mould knock-out, the faster cooling rate achieved by the method and apparatus described herein did not have any adverse effect on the strength or integrity of the final casting product. Furthermore, the method and apparatus allowed an increase in the production process throughput. Further benefits can be summarised as leading to:

improved moulding box availability;
a reduction in the number of moulding boxes required;
an increase re-use availability of mould sand;
a reduced casting cooling time of the order of 30-60%;
a casting lead time improvement of the order of 40-70%;
an increased flexibility in workspace floor layout;
an improved plant space utilisation.

The method and apparatus described herein can be used in conjunction with both sand casting and the Replicast® moulding and casting technique.

Whilst a method and apparatus for producing and cooling a cast component has been described with reference to some specific embodiments, it should be appreciated that the method and apparatus can be embodied in many other forms.

For example, depending on the component material, the cooling box can be provided with air ventilation holes in the sides or top plate for an increased rate of release of gas and heat. This may be controlled in such a way so as not to set up significant air movement within the box, which might otherwise induce thermal shock and cracking or breaking of the component. Optionally, extractor fans may be incorporated into the housing in situations where higher cooling rates can be tolerated. The thickness and/or performance parameters of insulation material can also be pared back to increase cooling rate.

Alternatively, to retard cooling rate, gases having an insulating/blanketing or even a heating effect (for example, controlled heated gases) may be initially introduced into and then optionally enclosed and maintained within the chamber during cooling. This retarding of rate can be performed in conjunction with increases of thickness and insulating performance of insulation material.

In one form of this, the chamber and the casting therein can be heated for a pre-determined interval to achieve a tempering or some other in-situ heat treatment of the casting. Instead of introducing heated gases merely as a means of controlling the chamber cooling rate, the chamber can be connected to a direct source of heating to positively raise the internal temperature. This heating can be direct, for example by use of gas burners to generate heat in the box, or indirectly by passing hot gases into the chamber.

Rather than removing the casting from the chamber after the interval in which a controlled rate of cooling occurs, the casting in the chamber can be reheated, which saves on reheating and cycle time costs. For example, in one embodiment the casting is cooled to ambient temperature in the chamber, and then moved to a second position to be trimmed and fettled. Depending on what it is, the casting may then need to be subjected to heat treatment, which necessitates reheating the casting in a second chamber or furnace, for example in the case of a white cast iron product by heating the casting to around 1000° C. for a pre-determined interval of around 4 hours to effect the heat treatment process.

By maintaining the casting in the chamber after the cooling interval, and then subjecting the casting to reheating can save on reheating costs by around 20-25% because there is no need to fully reheat the casting from ambient temperature up to the treatment temperature. Additionally the cycle time can be considerably shortened because the delay in reheating the product, as well as the losses in transfer time to and from reheating apparatus, are reduced.

The method and apparatus can be particularly and effectively applied for the cooling of castings of pump components such as impellers, shells/casings/housings (volutes), pump linings (such as frame plate liners), throat bushes and so on. However, a vast array of unrelated cast components and shapes can be cooled in accordance with the method and using the apparatus described herein.

In addition, the method and apparatus can be particularly and effectively applied to the cooling of cast ferrous alloys and certain other metals and metal-containing materials, especially brittle casting materials and/or casting materials that are susceptible to thermal shock Also, whilst a refractory blanket formed from a magnesium-calcium-silicate material has been described and tested, other blanket materials may be employed with certain casting materials, such as ceramic fibre blankets, vitreous magnesium-silicate fibre blankets, and other silica-type blankets including those spun from an alumina-silica-zirconia fibre, etc.

In a further alternative arrangement, the step of locating the casting in a chamber can take place in-situ of the mould—that is, the chamber may be formed around the newly solidified casting after knock-out but without moving the casting. In such an instance, all that may be required is removal of the cope of a moulding box. A chamber housing may then be adapted for placement directly onto the drag of the moulding box. This variation may arise when, for example, a sufficient amount of the casting is exposed by cope removal. The moulding box may also be re-designed to help facilitate this in-situ housing placement and controlled cooling.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "upper", "lower", "upwardly", "outermost", and the like are used as words of convenience to provide reference points and are not to be construed as limiting terms.

In order to avoid repetition, and for ease of reference, similar components and features of alternative embodiments that are shown in different drawings have been designated with an additional apostrophe, such as the base panel 12 in FIG. 1 and base panel 12' in FIGS. 2 to 6.

While the method and apparatus has been described with reference to a number of preferred embodiments it should be appreciated that the method and apparatus can be embodied in many other forms.

In the claims which follow and in the preceding description, except where the context requires otherwise due to express language or necessary implication, the words "comprise" and variations such as "comprises" or "comprising" are used in an inclusive sense, i.e. to specify the presence of the stated features but not to preclude the presence or addition of further features in various embodiments of the method and apparatus.

The invention claimed is:

1. A method for the cooling of a casting that is susceptible to thermal shock and/or cracking, the method comprising the steps of:

pouring molten material into a mould for forming the casting;

allowing the molten material to solidify;

removing the mould at least in part from the resulting solidified casting; and placing the solidified casting on a base of a cooling chamber and locating a cover of the cooling chamber on the base so that the cooling chamber is able to completely surround the solidified casting and to facilitate heat transfer between the solidified casting and the chamber so that the rate of cooling of the casting is controlled entirely by the cooling chamber whereby thermal shock and/or cracking of the casting is mitigated.

2. A method as claimed in claim 1 wherein the chamber is insulated to facilitate the controlled rate of cooling of the casting.

3. A method as claimed in claim 2 wherein insulation material, thickness, heat transfer coefficient, or combinations thereof, are selected to achieve the controlled rate of cooling of the casting.

4. A method as claimed in claim 3 wherein, when the material being cast is a white cast iron, the rate of casting cooling is controlled to be not greater than about 40° C./hour.

5. A method as claimed in claim 1 wherein the chamber is insulated so as to maintain a pre-selected temperature differential between a hottest portion and a coolest portion of the solidified casting.

6. A method as claimed in claim 5 wherein the hottest portion is located within the solidified casting and the coolest portion is located at an external surface of the solidified casting.

7. A method as claimed in claim 5 wherein, when the casting comprises a body with a hollow interior in which some mould material has been retained, the chamber is insulated so as to maintain a pre-selected temperature differential between (a) the solidified casting hollow interior in contact with that mould material and (b) an external surface of the solidified casting.

8. A method as claimed in claim 5 wherein the temperature of the casting external surface is determined from the chamber atmospheric temperature surrounding the casting.

9. A method as claimed in claim 5 wherein the pre-selected temperature differential is determined by the material being cast.

10. A method as claimed in claim 9 wherein, when the material being cast is white cast iron, the temperature differential is less than approximately 100° C.

11. A method as claimed in claim 1 wherein, prior to locating the solidified casting in the chamber, the mould is removed from an exterior of the casting.

12. A method as claimed in claim 11 comprising a further step of ventilating gases emitted from the mould during removal of the mould from the casting exterior.

13. A method as claimed in claim 1 wherein the cover comprises a housing which forms a remainder of the chamber that is located on the base to enclose the casting.

14. A method as claimed in claim 1 wherein, subsequent to the cooling process, the method further comprises the step of heating the chamber and the casting therein for a pre-determined interval.

15. A method as claimed in claim 14, wherein the step of heating the chamber effects a heat treatment process on the casting.

16. A method as claimed in claim 15, wherein the chamber is heated to a temperature of about 1000° C. for a pre-determined interval of about 4 hours to effect the heat treatment process.

17. A method as claimed in claim 1 comprising a further step of removing the casting from the chamber once it has cooled to a predetermined temperature.

18. A method as claimed in claim 17 wherein, when the material being cast is a white cast iron, the predetermined temperature is approximately 150° C. or less.

19. A method for the production of a casting, the method comprising the steps of:

pouring molten material into a mould for forming the casting;

allowing the molten material to solidify;

removing the mould at least in part from the resulting solidified casting; and placing the solidified casting on a base of a chamber, and locating a cover of the chamber on the base so that the chamber is able to completely surround the solidified casting and is constructed to facilitate heat transfer from the chamber interior to the chamber exterior such that the rate of cooling of the solidified casting is controlled entirely by the cooling chamber to mitigate thermal shock and/or cracking of the casting.

* * * * *